US006857942B1

(12) United States Patent
Lin et al.

(10) Patent No.: US 6,857,942 B1
(45) Date of Patent: Feb. 22, 2005

(54) APPARATUS AND METHOD FOR PRE-CONDITIONING A CONDITIONING DISC

(75) Inventors: Yu-Liang Lin, Hsin-Chu (TW); Chih-I Peng, Hsin-Chu (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 321 days.

(21) Appl. No.: 09/481,224

(22) Filed: Jan. 11, 2000

(51) Int. Cl.[7] ..... B24B 1/00
(52) U.S. Cl. ..... 451/56; 451/443
(58) Field of Search ..... 451/56, 443, 444

(56) References Cited

U.S. PATENT DOCUMENTS 5,626,509 A * 5/1997 Hayashi ..... 451/56
5,954,570 A * 9/1999 Yano et al. ..... 451/56
5,984,764 A * 11/1999 Saito et al. ..... 451/56
5,997,385 A * 12/1999 Nishio ..... 451/56
6,120,350 A * 9/2000 Zhou et al. ..... 451/56

* cited by examiner

*Primary Examiner*—Eileen P. Morgan
(74) *Attorney, Agent, or Firm*—Tung & Associates

(57) ABSTRACT

An apparatus and a method for off-line pre-conditioning a conditioning disc that is used in a chemical mechanical polishing process are provided. In the apparatus, an upper platform for mounting a conditioning disc thereto and a lower platform for mounting a polishing pad thereto are engaged together under a pre-set pressure and rotated in opposite directions for a pre-set length of time. The apparatus is effective in removing loose particles from the surface of the conditioning disc such that the possibility of any such particles causing scratches on a wafer surface during a subsequently conducted chemical mechanical polishing process is eliminated. The present invention novel apparatus can be used off-line for pre-conditioning a conditioning disc such that valuable machine time of a chemical mechanical polishing apparatus is not wasted.

20 Claims, 5 Drawing Sheets

( C )

Typical conditioner disk structure:

Side View

Side View

Top View

APPARATUS AND METHOD FOR PRE-CONDITIONING A CONDITIONING DISC

FIELD OF THE INVENTION

The present invention generally relates to an apparatus and a method for off-line pre-conditioning a conditioning disc and more particularly, relates to an apparatus and a method for off-line pre-conditioning a diamond-particle conditioning disc used in a chemical mechanical polishing apparatus such that all the loose diamond particles on the surface of the conditioning disc may be dislodged before the disc is used in a production process to avoid scratching of wafers.

BACKGROUND OF THE INVENTION

Apparatus for polishing thin, flat semiconductor wafers is well-known in the art. Such apparatus normally includes a polishing head which carries a membrane for engaging and forcing a semiconductor wafer against a wetted polishing surface, such as a polishing pad. Either the pad or the polishing head is rotated which oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in deionized water.

A schematic of a typical CMP apparatus is shown in FIGS. 1A and 1B. The apparatus 20 for chemical mechanical polishing consists of a rotating wafer holder 14 that holds the wafer 10, an appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing, a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. Polishing heads of the type described above used in the CMP process are shown in U.S. Pat. No. 4,141,180 to Gill, Jr., et al.; U.S. Pat. No. 5,205,082 to Shendon et al; and U.S. Pat. No. 5,643,061 to Jackson, et al. It is known in the art that uniformity in wafer polishing is a function of pressure, velocity and the concentration of chemicals. Edge exclusion is caused, in part, by a non-uniform pressure applied on a wafer. The problem is reduced somewhat through the use of a retaining ring which engages the polishing pad, as shown in the Shendon et al patent.

Referring now to FIG. 1C, wherein an improved CMP head, sometimes referred to as a Titan® head which differs from conventional CMP heads in two major respects is shown. First, the Titan® head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16, are urged downwardly toward the polishing pad 12 by a linear force indicated by the numeral 18 which is effected through a pneumatic system.

The polishing pad 12 is a consumable item used in a semiconductor wafer fabrication process. For instance, under normal wafer fab conditions, the polishing pad must be replaced after a usage of between 12 and 18 hours. Polishing pads may be hard, incompressible pads or soft pads. For oxide polishing, hard, incompressible and thus stiffer pads are generally used to achieve planarity. Softer pads are frequently used to achieve improved uniformity and smooth surfaces. The hard pads and the soft pads may also be combined in an arrangement of stacked pads for customized applications.

A problem frequently encountered in using polishing pads in a CMP process for oxide planarization is the rapid deterioration in polishing rates of the oxide with successive wafers. The cause for the deterioration has been shown to be due to an effect known as "pad-glazing" wherein the surface of the polishing pads become smooth such that the pads can no longer hold slurry in-between the fibers. This has been found to be a physical phenomenon on the surface, and is not caused by any chemical reactions between the pad and the slurry.

To remedy the pad glazing effect, numerous techniques of pad conditioning or scrubbing have been proposed to regenerate and restore the pad surface and thereby, restoring the polishing rates of the pad. The pad conditioning techniques include the use of silicon carbide particles, diamond emery paper, blade or knife for scrapping the polishing pad surface. The goal of the conditioning process is to remove polishing debris from the pad surface., reopen the pores, and thus forms micro scratches in the surface of the pad for improved lifetime of the pad surface. The pad conditioning process can be carried out either during a polishing process, i.e., known as concurrent conditioning, or after a polishing process.

While the pad conditioning process improves pad consistency and its lifetime, conventional apparatus of a conditioning disc is frequently not effective in conditioning a pad surface. For instance, a conventional conditioning disc for use in pad conditioning is shown in FIGS. 2A and 2B. The conditioning disc 30 is formed by embedding or encapsulating diamond particles 32 in a nickel layer 34 coated on the surface 36 of a rigid substrate 38. FIG. 2A is a cross-sectional view of a new conditioning disc with all the diamond particles 32,42 embedded in the nickel layer 34. After repeated usage as a conditioning disc, the cross-sectional view of the disc 30 is shown in FIG. 2B which shows that diamond particle 42 has been lost and the top surfaces of the remaining particles 32 are flattened. The loss of diamond particle from the nickel encapsulation layer 34 occurs frequently when the particle is not deeply embedded in the nickel layer 34. In the fabrication of the diamond particle conditioning disc 30, a nickel encapsulation layer 34 is first mixed with a diamond grit which includes the diamond particles 32,42 and then applied to the rigid substrate 38. The bonding of the diamond particles 32,42 is frequently insecure and thus the particles are easily lost from the nickel layer during usage. The diamond particle 42 which is lost from the nickel encapsulation layer 34 may be trapped between the surfaces of the polishing pad and the wafer and causes severe scratches on the wafer. Another drawback for the diamond conditioning disc is that the pad conditioning efficiency decreases through successive usage of the disc since the top surfaces of the diamond particles are flattened after repeated usage when the diamond grit mechanically abrades the pad surface.

A method for preventing wafer surfaces from being scratched by loose diamond particles that have been dislodged from a conditioned disc is to pre-condition the conditioning disc. Traditionally, this is done in a chemical mechanical polishing apparatus prior to the start of wafer polishing. FIG. 2C shows a conditioning disc 20 is pre-conditioned by polishing disc 12, while the conditioning disc 20 is rotated in a clockwise direction and the polishing pad 12 is rotated in a counter-clockwise direction. The conditioning disc 20 further moves in a linear direction, as shown in FIG. 2C by the ghost lines, in a regular pad conditioning process. In the conventional diamond disc conditioning process, a slurry solution at a flow rate of 200 sccm is utilized while the diamond disc is pressed down onto the polishing disc under a force of 7 lbs. The diamond disc is rotated in a clockwise direction at 63 rpm while the polishing pad is rotated in a counter-clockwise direction at 64 rpm. The pre-conditioning process is carried out for a time period of 30 minutes.

The conventional pre-conditioning process for diamond discs performs adequately in removing loose diamond particles from the disc surface. However, the pre-conditioning process takes at least 30 minutes of valuable fabrication time away from the CMP apparatus and thus reduces the fabrication yield of the machine. It is therefore desirable to conduct a pre-conditioning process on a conditioning disc without occupying a production equipment.

It is therefore an object of the present invention to provide an apparatus for pre-conditioning a conditioning disc that does not have the drawbacks or the shortcomings of the conventional apparatus.

It is another object of the present invention to provide an apparatus for carrying out a pre-conditioning process on a conditioning disc in an off-line manner without sacrificing machine time.

It is a further object of the present invention to provide an apparatus for off-line pre-conditioning a conditioning disc that can be carried out without affecting the fabrication yield of the chemical mechanical polishing apparatus.

It is another further object of the present invention to provide an apparatus for off-line pre-conditioning a conditioning disc that is capable of pressing a conditioning disc against a polishing pad under a suitable force.

It is still another object of the present invention to provide an apparatus for off-line pre-conditioning a conditioning disc that is capable of rotating the conditioning disc and a polishing pad in opposite directions.

It is yet another object of the present invention to provide an apparatus for off-line pre-conditioning a conditioning disc that is capable of dispensing a slurry solution in between the surfaces of the conditioning disc and the polishing pad.

It is still another further object of the present invention to provide a method for off-line pre-conditioning a conditioning disc by rotating the conditioning disc against a polishing pad in opposite directions in a pre-conditioning apparatus until all loose particles are removed from the conditioning disc.

It is yet another further object of the present invention to provide off-line pre-conditioning a conditioning disc by suitably adjusting a pressure exerted between the conditioning disc rotated against a polishing pad for a time period of at least 20 minutes until substantially all loose particles are dislodged from the surface of the conditioning disc.

SUMMARY OF THE INVENTION

In accordance with the present invention an apparatus and a method for pre-conditioning a conditioning disc are provided.

In a preferred embodiment, an apparatus for off-line pre-conditioning a conditioning disc is provided which includes an upper platform for mounting a conditioning disc thereto exposing a first surface to be pre-conditioned and for rotating in a first direction, a lower platform for mounting a polishing pad thereto exposing a second surface for pre-conditioning the conditioning disc and for rotating in a second direction opposite to the first direction, means for applying a pre-set pressure between the first surface and the second surface by pressing the two surfaces against each other, and means for moving vertically at least one of the upper platform and the lower platform toward the other.

The apparatus for off-line pre-conditioning a conditioning disc may further include a DC motor means for rotating the upper platform. The upper platform rotates in a clockwise direction and the lower platform rotates in a counter-clockwise direction. The apparatus may further include a DC motor means for rotating the lower platform. The first surface of the conditioning disc may include diamond particles and a nickel coating embedding the diamond particles. The polishing pad mounted on the lower platform may be a pad for a chemical mechanical polishing process. The apparatus may further include a slurry dispensing means for dispensing a liquid slurry between the first surface of the conditioning disc and the second surface of the polishing pad. The liquid slurry dispensed may be deionized water. The apparatus may further include means for applying a pre-set pressure of at least 5 lbs between the first surface and the second surface. The apparatus may further include means for applying a pressure between the first surface and the second surface that is capable of removing substantially all loose particles in the first surface of the conditioning disc in a time period of at least 10 minutes. The apparatus may further include motor means for rotating the upper platform at a rotational speed of at least 20 rpm, or motor means for rotating a lower platform at a rotational speed of at least 40 rpm.

The present invention is further directed to a method for off-line pre-conditioning a conditioning disc which can be carried out by the operating steps of first providing a pre-conditioning apparatus equipped with a rotatable upper platform, a rotatable lower platform, means for applying a pressure between the upper platform and the lower platform and means for moving the upper platform and the lower platform toward each other, mounting a conditioning disc to the upper platform with a first surface of the conditioning disc to be pre-conditioned exposed, mounting a polishing pad to the lower platform with a second surface of the polishing pad for pre-conditioning the conditioning disc exposed and positioned facing the first surface of the conditioning disc, rotating the conditioning disc on the upper platform in a first direction, rotating the polishing pad on the lower platform in a second direction that is opposite to the first direction, and pressing the first surface of the conditioning disc against the second surface of the polishing pad for a pre-set length of time while the conditioning disc and the polishing pad are rotated in opposite directions.

The method for off-line pre-condition a conditioning disc may further include the step of dispensing a slurry on the second surface of the polishing pad during the step of pressing the first surface of the conditioning disc against the second surface of the polishing pad. The method may further include the step of removing substantially all loose particles on the first surface of the conditioning pad after the pre-set lengths of time. The method may further include a step of removing substantially all loose diamond particles embedded in a nickel layer on the first surface of the conditioning disc after the pre-set length of time. The method may further include a step of rotating the upper platform with the conditioning disc mounted thereon at a rotational speed of at least 20 rpm, or the step of rotating the lower platform with the polishing disc mounted thereon at a rotational speed of at least 40 rpm. The method may further include the step of pressing the first surface against the second surface at a pressure of at least 5 lbs when the conditioning disc has a diameter of at least 3 inches. The method may further include the step of pressing the first surface of the conditioning disc against a second surface of the polishing pad for at least 10 minutes at a pressure sufficient to remove substantially all the loose particles in the first surface.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses an apparatus and a method for off-line pre-conditioning a conditioning disc that is used in a chemical mechanical polishing process such that valuable machine time is not lost and fabrication yield is not sacrificed.

Figure 3:
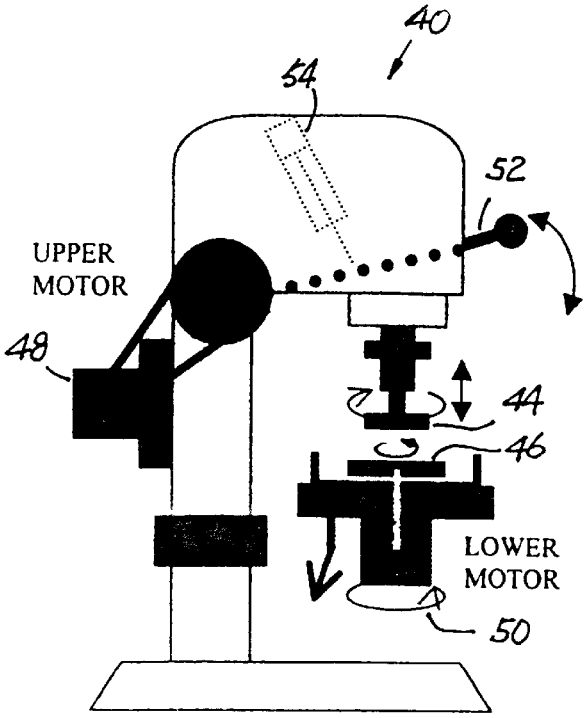
FIG. 3 is a side view of the present invention novel apparatus for off-line pre-conditioning a conditioning disc.

Referring initially to FIG. 3, wherein a side view of the present invention novel apparatus 40 is shown. The novel apparatus 40 is constructed by an upper platform 44, a lower platform 46, a DC motor 48 for rotating the upper platform 44, a DC motor 50 for rotating the lower platform 46, and means 52 for moving the upper platform 44 in a vertically up-and-down position to apply a pressure between the upper platform 44 and the lower platform 46. Once a suitable pressure is applied, as indicative by a pressure gauge (not shown), the position of the upper platform 44 may be locked by a locking device 54. A means (not shown) to further adjust vertically the position of the lower platform 46 is also provided to increase the versatility of the apparatus 40.

As shown in FIG. 3, the upper platform 44 may be rotated in a first direction, i.e. in a clockwise direction, while the lower platform 46 may be rotated in a second direction that is opposite to the first direction, i.e in a counter-clockwise direction. The rotational speed for the upper platform 44 and the lower platform 46 may be suitably controlled between about 10 rpm and about 100 rpm, and more preferably between about 40 rpm and about 80 rpm. The word "about", as used in the context of this writing, indicates a range of value of ±10% from an average value given. A suitable force for compressing the upper platform against the lower platform may be between about 5 lbs and about 50 lbs.

Figure 1:
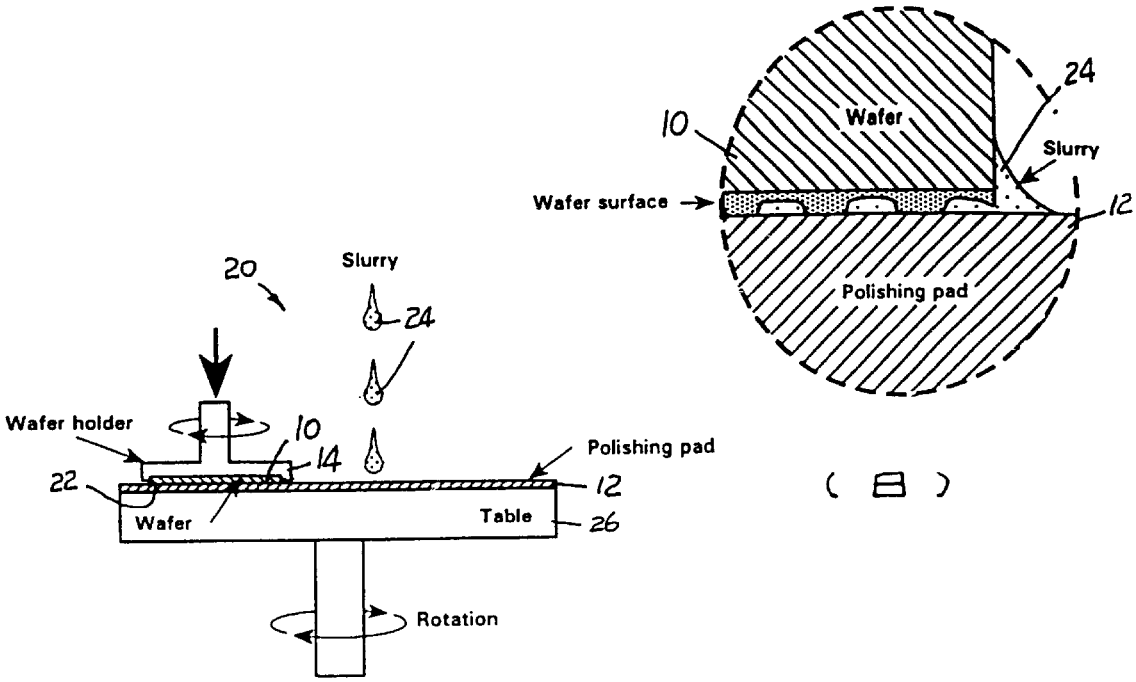
Fig 1 (Prior Art)
FIG. 1A is a simplified cross-sectional view of a typical chemical mechanical polishing apparatus.
FIG. 1B is an enlarged, cross-sectional view illustrating the interaction of a slurry solution between a wafer surface and a polishing pad.
FIG. 1C is a cross-sectional view illustrating a typical, pressurized wafer mounting head for a chemical mechanical polishing apparatus.
Figure 1:
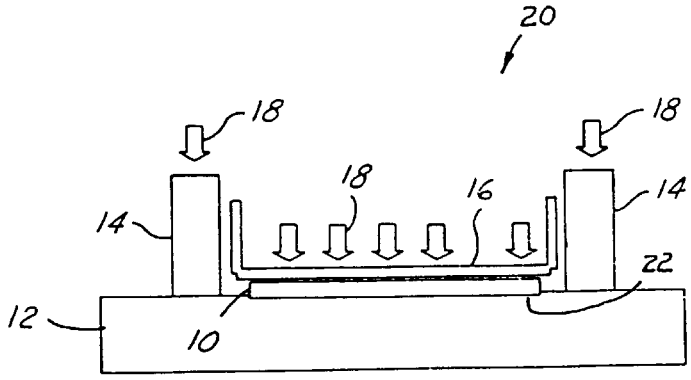
Fig 1 (Prior Art)
Figure 2A:
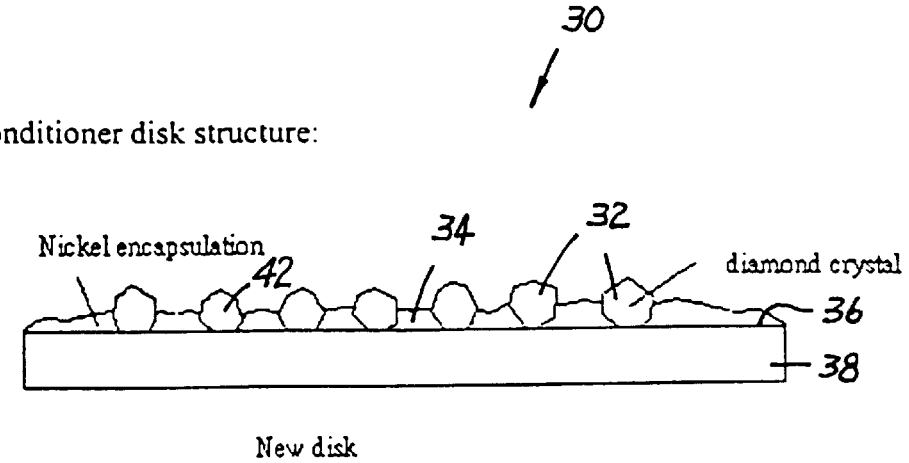
Fig 2 A (Prior Art)
FIG. 2A is an enlarged, cross-sectional view of a typical conditioning disc with diamond particles embedded in a nickel coating layer.
Figure 2B:
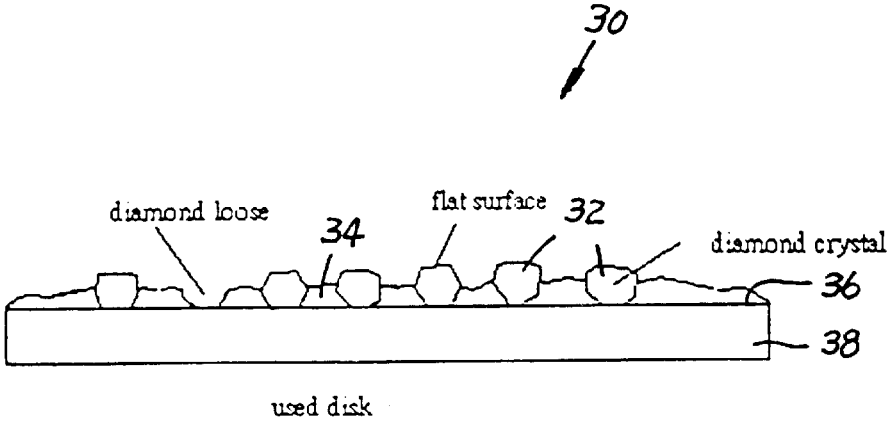
Fig 2 B (Prior Art)
FIG. 2B is an enlarged, cross-sectional view of the diamond conditioning disc of FIG. 2A after usage illustrating diamond particles have been lost from the disc surface.
Figure 2C:
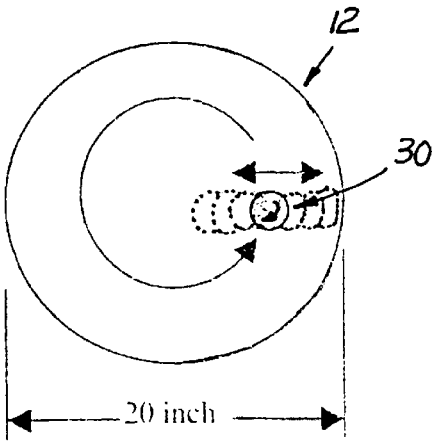
Fig 2C (Prior Art)
FIG. 2C is a plain view illustrating a conventional conditioning disc pre-conditioning process wherein a conditioning disc engages a polishing pad.
Figure 3A:
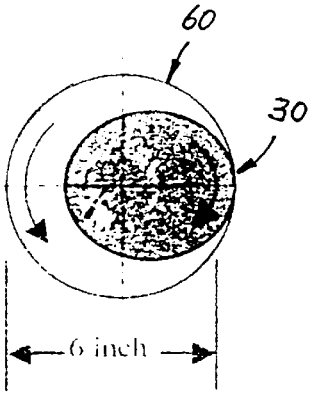
FIG. 3A is a plain view illustrating the present invention pre-conditioning process wherein a conditioning disc engages a polishing pad.

A plain view of the present invention apparatus wherein a conditioning disc 30 engages a polishing pad 60 is shown in FIG. 3A. The conditioning disc 30 may have a suitable diameter of about 4 inches while the polishing disc 60 may have a suitable diameter of about 6 inches. The polishing pad 60 may be cut from a regular polishing pad of much larger diameter, as shown in FIG. 2C, such that the same polishing pad surface can be used for pre-conditioning the conditioning disc 30.

Figure 3B:
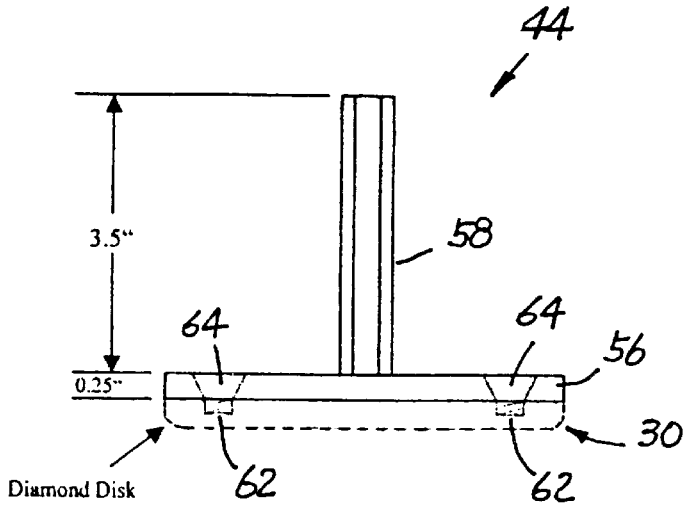
FIG. 3B is a cross-sectional view of the present invention upper platform for mounting a conditioning disc thereto.
Figure 3C:
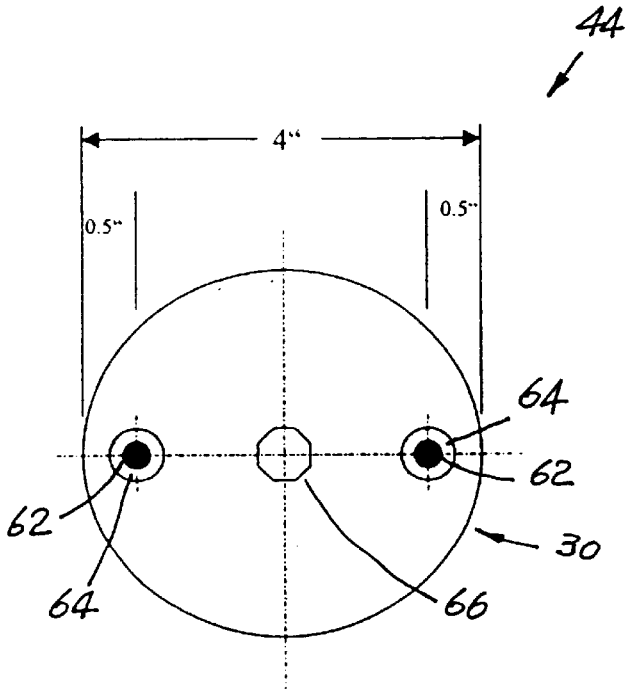
FIG. 3C is a bottom view of the upper platform of FIG. 3B illustrating the mounting holes.

An enlarged cross-sectional view of the upper platform 44 is further shown in FIG. 3B while a bottom view of the upper platform 44 is shown in FIG. 3C. A diamond disc 30 for pre-conditioning is mounted to the flat disc 56 of the upper platform 44 for rotating by shaft 58 which is engaged to DC motor 48 by pulley means and belt means (not shown). As shown in FIG. 3C, a conditioning disc, or diamond disc 30 is mounted to the flat disc 56 by at least two screw means 62 into mounting holes 64 provided in the flat disc 56. The shaft 58 is mounted to the flat disc 56 by bolt means 66.

Figure 4:
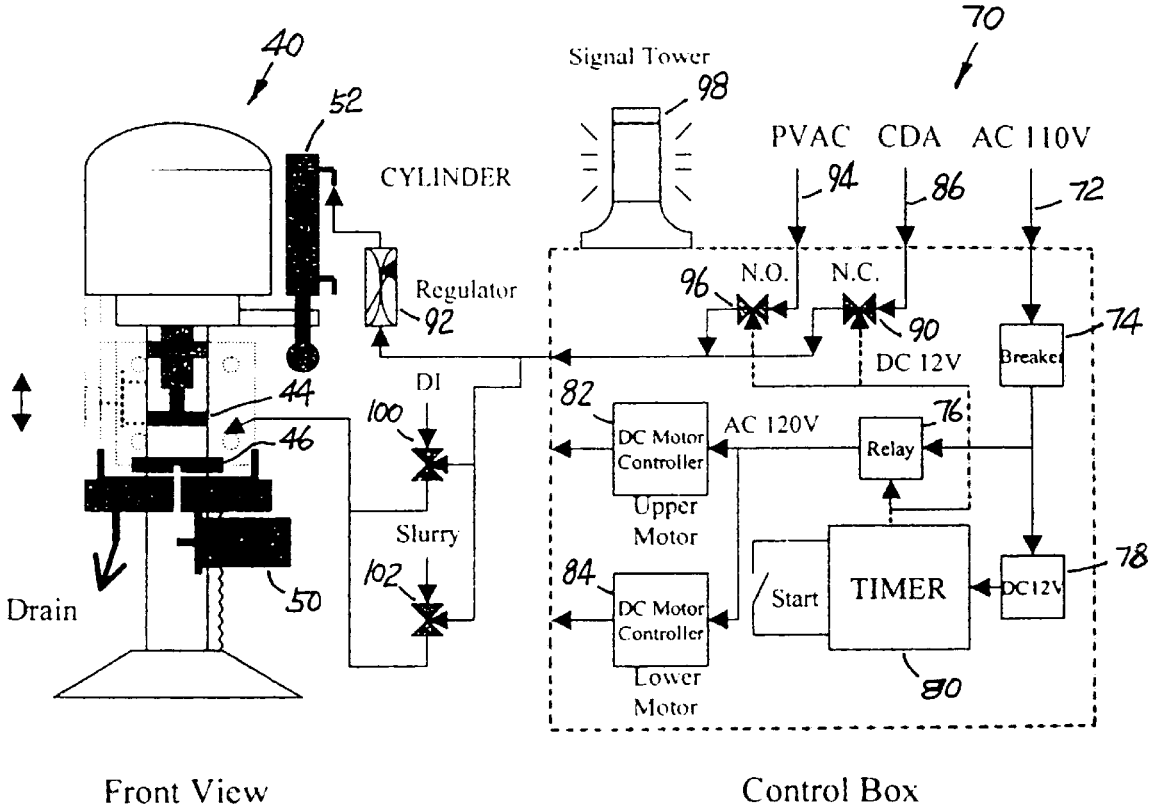
FIG. 4 is a front view of the present invention novel apparatus for pre-conditioning a conditioning disc off-line together with a control circuit for the apparatus.

FIG. 4 illustrates a front view of the present invention novel apparatus 40 together with a control circuit 70 illustrating a simplified control flow chart for the apparatus 40. In the control circuit 70, an AC power 72 is first fed through breaker 74 and then to both a relay 76 and a DC 12 volt converter 78. The DC voltage from converter 78 is then sent to a timer 80 for controlling the pre-conditioning time for the conditioning disc. DC motors 82,84 are used for rotating the upper platform 44 and the lower platform 46, respectively. A clean dry air (CDA) source 86 is controlled by a normal-closed valve 90 and sent through pressure regulator 92 and then to the pressure control means 52 for controlling the pressure exerted between the upper platform 44 and the lower platform 46 during the pre-conditioning process. A process vacuum 94 is further used and controlled by a normal-open valve 46 for controlling the pressure means 52 by regulating the pressure of the clean dry air 86. The control system 70 is further connected to a signal means 98 for sounding an alarm or flashing a warning light when a system malfunction is detected. The clean dry air source 86 and the process vacuum source 94 are further used to control a deionized water supply 100 and a slurry supply 102 which are connected in a parallel manner for applying a slurry solution or deionized water to the polishing pad (not shown) mounted on the lower platform 46 during the pre-conditioning process.

In a typical pre-conditioning process utilizing the present invention novel apparatus 40, a slurry solution of deionized water is normally used while the upper platform is turned at about 40 rpm in a clockwise direction and the lower platform is turned at about 80 rpm in a counter-clockwise direction. A compression force of about 5 lbs, and preferably about 9 lbs, is used for pressing a conditioning disc against the polishing pad. The total time required for the pre-conditioning process is about 25 minutes. A typical polishing pad utilized may last between about 20 and about 30 conditioning discs. The present invention novel apparatus is therefore able to save at least about 9 hours per day of the machine time on a chemical mechanical polishing apparatus since at least between 4 and 6 conditioning discs must be pre-conditioned per day each for a pre-conditioning time of about 30 minutes, and an installation time of about 1 hour in a fab plant.

The present invention novel apparatus and method for off-line pre-conditioning a conditioning disc has therefore been amply described in the above description and in the appended drawings of FIGS. 3, 3A–3C and 4.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the invention.

The embodiment of the invention in which an exclusive property or privilege is claimed are defined as follows.

What is claimed is:

1. An apparatus for off-line pre-conditioning a conditioning disc comprising:

an upper platform not situated in a CMP apparatus for mounting a conditioning disc thereto exposing a first surface to be preconditioned and for rotating in a first direction;

a lower platform not situated in a CMP apparatus for mounting a polishing pad thereto exposing a surface for pre-conditioning said conditioning disc and for rotating in a second direction opposite to said first direction;

means for applying a preset pressure between said first surface and said second surface by pressing said two surfaces against each other; and means for moving vertically at least one of said upper platform and said lower platform toward the other.

2. An apparatus for off-line pre-conditioning a conditioning disc according to claim 1 further comprising a DC motor means for rotating said upper platform.

3. An apparatus for off-line pre-conditioning a conditioning disc according to claim 1, wherein said lower platform rotates in a counter-clockwise direction.

4. An apparatus for off-line pre-conditioning a conditioning disc according to claim 1 further comprising a DC motor means for rotating said lower platform.

5. An apparatus for off-line pre-conditioning a conditioning disc according to claim 1, wherein said first surface of the conditioning disc comprises diamond particles and a nickel coating embedding said diamond particles.

6. An apparatus for off-line pre-conditioning a conditioning disc according to claim 1, wherein said polishing pad mounted on said lower platform is a pad for a chemical mechanical polishing process.

7. An apparatus for off-line pre-conditioning a conditioning disc according to claim 1 further comprising a slurry dispensing means for dispensing a liquid slurry between said first surface of the conditioning disc and said second surface of the polishing pad.

8. An apparatus for off-line pre-conditioning a conditioning disc according to claim 7, wherein said liquid slurry dispensed is deionized water.

9. An apparatus for off-line pre-conditioning a conditioning disc according to claim 1 further comprising means for applying a preset pressure of at least 5 lbs between said first surface and said second surface.

10. An apparatus for off-line pre-conditioning a conditioning disc according to claim 1 further comprising means for applying a pressure between said first surface and said second surface that is capable of removing substantially all loose particles in said first surface of the conditioning disc in a time period of at least 10 minutes.

11. An apparatus for off-line pre-conditioning a conditioning disc according to claim 1 further comprising motor means for rotating said upper platform at a rotational speed of at least 20 rpm.

12. An apparatus for off-line pre-conditioning a conditioning disc according to claim 1 further comprising motor means for rotating said lower platform at a rotational speed of at least 40 rpm.

13. A method for off-line pre-conditioning a conditioning disc comprising the steps of:

providing a pre-conditioning apparatus not situated in a CMP apparatus equipped with a rotatable upper platform, a rotatable lower platform, means for applying a pressure between said upper platform and said lower platform and means for moving said upper platform and said lower platform toward each other;

mounting a conditioning disc to said upper platform with a first surface of said conditioning disc to be pre-conditioned exposed;

mounting a polishing pad to said lower platform with a second surface of said polishing pad for pre-conditioning said conditioning disc exposed and positioned facing said first surface of said conditioning disc;

rotating said conditioning disc on said upper platform in a first direction;

rotating said polishing pad on said lower platform in a second direction opposite to said first direction; and pressing said first surface of the conditioning disc against said second surface of the polishing pad for a preset length of time while said conditioning disc and said polishing pad rotates in opposite directions.

14. A method for off-line pre-conditioning a conditioning disc according to claim 13 further comprising the step of dispensing a slurry on said second surface of said polishing pad during said step of pressing said first surface of the conditioning disc against said second surface of the polishing pad.

15. A method for off-line pre-conditioning a conditioning disc according to claim 13 further comprising the step of removing substantially all loose particles on said first surface of the conditioning disc after said preset length of time.

16. A method for off-line pre-conditioning a conditioning disc according to claim 13 further comprising the step of removing substantially all loose diamond particles embedded in a nickel layer on said first surface of the conditioning disc after said preset length of time.

17. A method for off-line pre-conditioning a conditioning disc according to claim 13 further comprising the step of rotating said upper platform with said conditioning disc mounted thereon at a rotational speed of at least 20 rpm.

18. A method for off-line pre-conditioning a conditioning disc according to claim 13 further comprising the step of rotating said lower platform with said polishing disc mounted thereon at a rotational speed of at least 40 rpm.

19. A method for off-line pre-conditioning a conditioning disc according to claim 13 further comprising the step of pressing said first surface against said second surface at a pressure of at least 5 lbs when said conditioning disc has a diameter of at least 3 inches.

20. A method for off-line pre-conditioning a conditioning disc according to claim 13 further comprising the step of pressing said first surface of the conditioning disc against said second surface of the polishing pad for at least 10 minutes at a pressure sufficient to remove substantially all loose particles in said first surface.

* * * * *